United States Patent [19]

von Bernuth et al.

[11] 4,168,033

[45] Sep. 18, 1979

[54] TWO-PIECE WEAR-RESISTANT SPRAY NOZZLE CONSTRUCTION

[75] Inventors: Robert von Bernuth; Dan Simpson, both of Glendora, Calif.

[73] Assignee: Rain Bird Sprinkler Mfg. Corp., Glendora, Calif.

[21] Appl. No.: 813,274

[22] Filed: Jul. 6, 1977

[51] Int. Cl.[2] ..... B05B 1/26

[52] U.S. Cl. ..... 239/523; 239/591; 239/600

[58] Field of Search ..... 239/523, 524, 591, 599, 239/600, 498, 390, 396

[56] References Cited

U.S. PATENT DOCUMENTS

| | | | |
|---|---|---|---|
| 691,758 | 1/1902 | Gay | 239/498 |
| 1,177,884 | 4/1916 | Molesta et al. | 239/523 |
| 1,805,782 | 5/1931 | Munz | 239/524 X |
| 3,034,728 | 5/1962 | Hruby, Jr. | 239/524 |
| 3,488,006 | 1/1970 | Gigantino | 239/599 |
| 3,779,431 | 12/1973 | Tinnes et al. | 239/599 X |
| 3,785,572 | 1/1974 | Arnold et al. | 239/524 X |

*Primary Examiner*—John J. Love
*Assistant Examiner*—Michael J. Forman
*Attorney, Agent, or Firm*—Fulwider, Patton

[57] ABSTRACT

A spray nozzle having a brass housing and a urethane insert that is relatively resistant to wear by contact with the flow of irrigation water. The insert protects the more costly housing from erosion and is easily replaced if it becomes worn or if it is necessary to change the spray pattern. The housing can form a sleeve in which the insert is slidably received so that the housing is completely insulated from contact with the water flow. In one embodiment, the insert forms a concave deflector having ridges on a surface impinged by the water so that the spray emitted consists of discrete streams for greater distance and wind resistance. The water is emitted toward the deflector through an oblong orifice for more uniform lateral water distribution.

16 Claims, 6 Drawing Figures

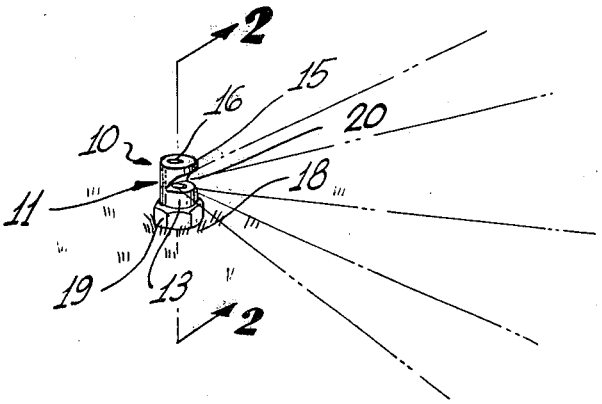
Fig. 1
Fig. 2
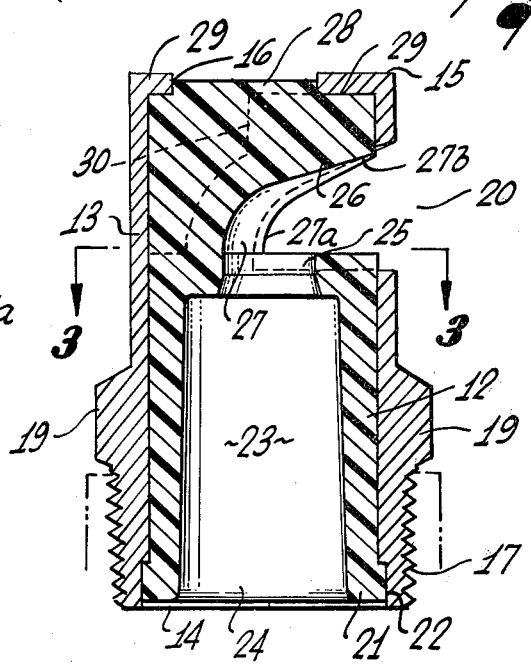
Fig. 3
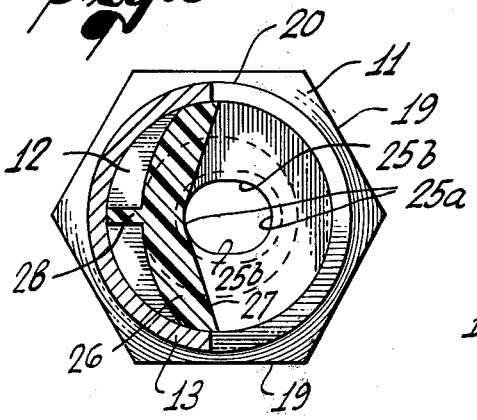
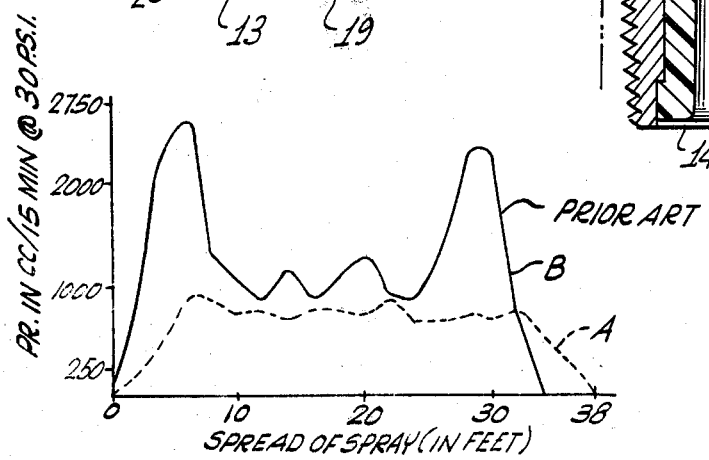
Fig. 4
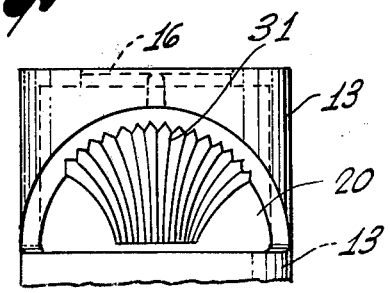
Fig. 6
Fig. 5
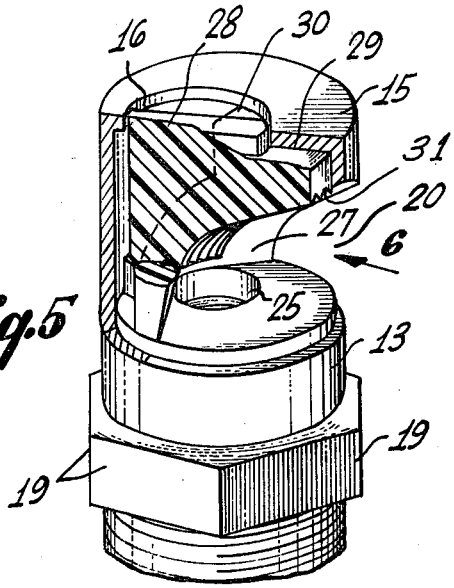

TWO-PIECE WEAR-RESISTANT SPRAY NOZZLE CONSTRUCTION

BACKGROUND OF THE INVENTION

The present invention relates to a spray nozzle for an irrigation apparatus.

Spray nozzles for use with pivot type irrigation machines, tractor spray bars, and similar devices are commonly made of brass, which is corrosion-resistant and easily machined. A problem commonly associated with such nozzles is that they are quickly eroded by the flow of irrigation water, particuarly if the water has a high abrasive content as is the case in many agricultural environments. In some instances, an orifice where water is emitted from the nozzle or a deflector surface that determines the spray pattern of the nozzle can be worn, after a single day of use, to the extent that the spray pattern of the nozzle is substantially altered and its efficiency is greatly reduced. Other materials that have been proposed as substitutes for brass in the construction of spray nozzles have proven unsatisfactory, however, and brass nozzles continue to be the industry standard.

Another problem associated with presently known spray nozzles is that they are generally capable of producing only one spray pattern, assuming a given water supply pressure. It is sometimes desired to change this pattern to accommodate a different arrangement of crops, changes of season, or climatic variations. This traditionally necessitates replacement of the relatively expensive brass spray nozzles. It has also been found that spray nozzles of traditional design produce an unequal lateral distribution of water, the heaviest concentrations being at the edges of the pattern.

A principal object of the present invention is to overcome the problems of erosion usually associated with spray nozzles, provide a more uniform lateral distribution of water within the spray pattern, and at the same time provide a nozzle that readily permits modification of its spray pattern.

SUMMARY OF THE PRESENT INVENTION

The present invention relates to a spray nozzle that accomplishes the above objectives by utilizing a housing and a wear-resistant, removable insert or attachment. The housing may be metal, preferably brass, and the insert of abrasion-resistant plastic, preferably urethane.

In one form of the invention, the housing defines a generally vertical sleeve with an open bottom end, and a urethane insert is slidably received within the housing. Upward axial movement and rotation of the insert within the housing are prevented by engagement of the insert with a restraining member at the top of the housing.

The insert may include a water channel with an open bottom end that is held in communication with the water source and an orifice at the top end of the channel through which the water is emitted. A deflector is disposed above the orifice, causing the emitted water to be deflected outwardly through a cut-away portion of the housing. Preferably the orifice is oblong, having its longest dimension in the direction of the center of the spray pattern, thereby improving the lateral uniformity of water distribution throughout the spray pattern.

It should be noted that the brass housing provides the strength of the nozzle and the attachment threads by which it is connected to the water source, but the irrigation water flow contacts only the wear-resistant urethane insert. If the insert eventually becomes worn or it is necessary to change the spray pattern, the insert can be quickly and easily replaced.

The deflector surface of the insert that is impinged by the water may be provided with an array of ridges on a concave surface that fan outwardly from the orifice to channel the water into discrete streams. The water spray from this deflector achieves increased distance and is less sensitive to winds, when compared to the finer spray that results from a smooth deflector surface.

Other features and advantages of the present invention will become apparent from the following detailed drawings which illustrate, by way of example, the principles of the invention.

BRIEF DESCRIPTION OF THE DRAWINGS

FIG. 1 is a perspective view of a spray nozzle embodying novel features of the present invention;

FIG. 2 is a cross-sectional view of the spray nozzle of FIG. 1, taken substantially along the line 2—2;

FIG. 3 is another cross-sectional view taken substantially along the line 3—3 of FIG. 2;

FIG. 4 is a graph showing the approximate lateral water distribution achieved by the nozzle of the present invention compared to the distribution achieved using a more conventional nozzle; and FIG. 5 is a perspective view of a second embodiment of the invention.

FIG. 6 is a fragmentary view of the embodiment illustrated in FIG. 5 and taken in the direction of line 6 in FIG. 5.

DESCRIPTION OF THE PREFERRED EMBODIMENTS

An exemplary spray nozzle 10 embodying many novel features of the present invention is depicted in FIGS. 1–3 of the accompanying drawings. It is of two-piece construction, including an outer machined brass housing 11 and an inner, molded plastic, preferably urethane, insert 12.

As best seen in FIGS. 1 and 2, the housing 11 is generally cylindrical, having a vertical sleeve portion 13 with an open bottom end 14. At the top of the sleeve is a horizontal top piece 15 with an off-center aperture 16. A threaded surface 17 adjacent the bottom end of the sleeve facilitates attachment to an irrigation water source 18 and a plurality of lands 19 encircle the sleeve just above the threads to facilitate engagement by a wrench. A portion 20 of the sleeve sidewall above its vertical center is cut away to permit a spray of irrigation water to be emitted. Being machined from brass, the housing could be quickly eroded by the flow of irrigation water, were it not protected by the insert 12 which is axially received within the sleeve.

The insert 12 is generally cylindrical and can be slid snugly into the sleeve 13 where it is retained by a force-fit between an external flange 21 surrounding the bottom edge of the insert and an internal groove 22 at the bottom edge of the sleeve. Since the insert is formed by a single piece of molded urethane, it is sufficiently elastic to be held tightly within the housing, but can be readily removed by a downward pull.

A cylindrical water channel 23 extends upwardly from the open bottom end 24 of the insert, where it is held in communication with the water source 18, to an orifice 25 at the top. Integrally molded with the channel portion of the insert is a deflector 26 which extends over the orifice presenting a concave surface 27. Water emitted upwardly through the orifice under pressure impinges on the deflector and is deflected outwardly through the cut-away portion 20 of the housing 11. The spray pattern produced by the deflector is a function of the shape and position of the concave surface 27. However, regardless of the particular spray pattern desired, uniformity of distribution is always an objective, and an important aspect of the present invention lies in the attainment of a substantially uniform spray distribution by employing specific geometric characteristics of the deflector 26 and the orifice 25.

So that the lateral distribution of irrigation water across the spray pattern will be substantially uniform, the orifice 25 is made oblong, being symmetrical about two axes, as shown in FIG. 3. More specifically, in the illustrative embodiment, the cross section of the orifice 25 is an oblong or oval having two semi-circular portions 25*a* which merge with, and are connected by, two substantially straight and parallel sides 25*b*. An eliptical cross section could also be utilized for the same purpose. The longer axis of the orifice cross section, i.e., the axis parallel with the sides 25*b*, is perpendicular to the deflector 26, and is aligned with the center of the spray pattern.

In FIG. 4, a typical lateral water distribution pattern achieved with the oblong orifice of the invention is shown, approximated by the broken line A. After fifteen minutes, the accumulation in a container of 0.296 inches diameter from a single nozzle 10 operating at 30 psi was approximately 800 cc for each foot across the thirty-eight foot pattern, tapering off over the last six feet on each side. The solid line B approximates the less uniform distribution achieved by a conventional round orifice under similar conditions. Throughout most of the thirty-four foot pattern, the accumulation was about 1100 cc per foot, but the water is sharply concentrated along the pattern edges, resulting in an accumulation there of about 2,700 cc.

Another important factor contributing to the uniformity of the spray distribution resulting from the present invention is the specific shape of the concave deflector surface 27. Viewed as in FIG. 2, from one side of the nozzle 10 and from the side of the spray pattern, the surface 27 has a lower portion 27*a* which extends perpendicularly upwards from the top of the cylindrical water channel 23, then curves upwards and outwards over the orifice 25, terminating in a relatively flat upper portion 27*b*. In plan view (FIG. 3), the lower portion 27*a* of the surface 27 has a curved central portion which is, in part, co-extensive with one of the semi-circular portions 25*a* of the orifice 25. This curved central portion merges with two symmetrically arranged, relatively straight portions, as clearly shown in FIG. 3. As the surface 27 curves upwards from its lower portion 27*a* to its upper portion 27*b*, there is a gradual transition from the relatively small radius of curvature (corresponding to the radius of the orifice at 25*a*) to a larger radius near the upper portion 27*b*.

The surface 27 may be described as having a compound radius of curvature, i.e., one which progresses smoothly from a relatively small magnitude to a larger one, but not in a spherical fashion. The surface 27 shaped in this manner cooperates with the orifice 25 to provide a substantially uniform spray distribution which was not previously obtainable using all-metal nozzles. One reason for this is that the desired form of the surface 27, with its relatively complex curvature characteristics, cannot be conveniently reproduced in all-metal form, since no machine tool could be easily set up to form such a surface in production quantities.

Rotation of the insert 12 within the housing 11 is prevented by a vertical rib 28, perpendicular to the curved surface 27, which projects upwardly from the deflector 26 into the off-center aperture 16. Notches 29 at the top corners of the rib receive the housing top piece 15 on either side of the aperture, and a second vertical rib 30, perpendicular to the anti-rotation rib 28, abuts against the underside of the top piece. The top piece therefore performs the additional function of restraining upward axial movement of the insert.

It should be noted that different spray patterns and water distribution rates can be produced by changing the dimensions of the orifice 25 and the configuration of the deflector 26. Since the insert 12 is easily removed, a different insert can easily be substituted to alter the spray pattern or distribution rate as desired. Substitution of the inserts might be needed, for example, to accommodate seasonal changes in the weather or changes in the crops being irrigated. Moreover, all water flow is across the surface of the urethane insert 12, which completely protects the brass housing 11 from erosion. The insert is relatively inexpensive compared to the housing, so that it is feasible to replace inserts as needed when wear does occur, thereby greatly increasing the life and versatility of the housing.

A similar spray nozzle that embodies additional novel features of the present invention is shown in FIGS. 5 and 6 in which corresponding portions of the device are identified by the same reference numbers used with respect to FIGS. 1 through 3. The insert 12 of the nozzle differs from the insert described above in that its concave deflector surface 27 is striated by an array of ribs 31 that fan outwardly and away from the orifice 25. The ribs cause the water to form discrete streams resulting in a spray that attains surprisingly greater distance with less effect by the wind as compared to the finer spray that would result if the deflector surface were smooth.

While particular forms of the invention have been illustrated and described, it will be apparent that various modifications can be made without departing from the spirit and scope of the invention.

We claim:

1. A spray nozzle for an irrigation apparatus comprising:

an insert defining a generally vertical water channel having an open end, an orifice at the top end of said channel for emitting water than enters said channel through said bottom end, and deflector means disposed above said orifice for causing water emitted from said orifice to form a predetermined spray pattern; and a housing including a vertically oriented sleeve portion for slidably and removably receiving said insert, said sleeve portion having a cylindrical interior, a section of said sleeve portion aligned with said deflector means being cut away to permit the emission of said spray pattern, said housing including restraining means for limiting upward axial movement of said insert within said sleeve portion, and attachment means for connecting said housing to an irrigation water source;

said housing being a machined metal member susceptible of excessive wear by contact with irrigation water flow, and said insert being a molded plastic member that is comparatively resistant to wear by contact with said irrigation water flow.

2. The spray nozzle of claim 1 wherein said insert is made of urethane.

3. The spray nozzle of claim 2 wherein said housing is made of brass.

4. The spray nozzle of claim 1 wherein said attachment means comprises a threaded surface on an exterior surface of said sleeve portion and at the lower end thereof.

5. The spray nozzle of claim 1 wherein said deflector means comprises a curved surface arranged to direct the center of said spray pattern in a predetermined direction, said orifice being oblong and symmetrical about its two transverse axes, the longer of said axes being oriented in said predetermined direction.

6. The spray nozzle of claim 5, wherein said curved surface is striated by an array of ribs that fan outwardly from said orifice to produce a spray pattern made up of discrete streams.

7. The spray nozzle of claim 1 wherein said insert includes an exterior flange surrounding the bottom end thereof, said flange being dimensioned to form a forcefit with the interior of said sleeve portion.

8. A spray nozzle for an irrigation apparatus comprising:

an insert defining a generally vertical water channel having an open end, an orifice at the top end of said channel for emitting water that enters said channel through said bottom end, and deflector means disposed above said orifice for causing water emitted from said orifice to form a predetermined spray pattern; and a housing including a vertical oriented sleeve portion for slidably and removably receiving said insert, restraining means for limiting upward axial movement of said insert within said sleeve portion, said restraining means comprising a generally horizontal top piece extending across the top end of said sleeve portion, a section of said sleeve portion aligned with said deflector means being cut away to permit the emission of said spray pattern, and attachment means for connecting said housing to an irrigation water source;

said housing being a machined metal member susceptible of excessive wear by contact with irrigation water flow, and said insert being a molded plastic member that is comparatively resistant to wear by contact with said irrigation water flow.

9. The spray nozzle of claim 8 wherein said top piece has an aperture therein that is off-center with respect to said sleeve, said insert including means for engaging said aperture to prevent rotation of said insert with respect to said housing.

10. A spray nozzle for an irrigation apparatus comprising:

a molded plastic insert having a cylindrical water channel portion with an inlet for irrigation water at the bottom end thereof and an orifice for emitting irrigation water at the top end thereof, and a deflector portion atop said insert including a curved deflector surface means extending over said orifice for deflecting water emitted by said orifice in a predetermined pattern;

a generally cylindrical machined metal housing including a sleeve portion in which said insert is releasably retained in a stationary position, a restraining member extending across said sleeve and above said insert to limit upward axial movement of said insert within said sleeve, a section of said sleeve portion aligned with said deflector means being cut away to permit the emission of said pattern, and threaded surface means surrounding a part of said sleeve portion for holding the bottom end of said insert in communication with an irrigation water source;

said housing being susceptible of excessive wear by contact with irrigation water flow, and said insert being comparatively resistant to wear by contact with said irrigation water flow, said insert protecting said housing from wear.

11. The spray nozzle of claim 10 wherein said deflector surface means defines an array of ribs that fan outwardly from said orifice to produce a spray pattern made up of discrete streams.

12. The spray nozzle of claim 10 wherein said insert is made of urethane.

13. The spray nozzle of claim 10 wherein said restraining member has an aperture therein, said aperture being off-center with respect to said sleeve, and said insert has a vertical anti-rotation rib extending above said deflector surface means and engaging said aperture to prevent rotation of said sleeve portion.

14. The spray nozzle of claim 13 wherein said anti-rotation rib has notches therein, said restraining member being engaged by said notches.

15. The spray nozzle of claim 10 wherein said deflector surface means is arranged to direct the center of said spray pattern in a predetermined direction, said orifice being oblong and symmetrical about its two transverse axes, the longer of said axes being oriented in said predetermined direction.

16. A two-piece spray nozzle for an irrigation apparatus comprising:

a molded one-piece urethane insert having a cylindrical water channel portion with an open bottom end providing an inlet for irrigation water and an orifice at the top end thereof for emitting irrigation water, said orifice being oblong and having two symmetrical axes, one of which is longer than the other;

said insert also having a curved, striated deflector surface extending over said orifice for deflecting water emitted by said orifice in a predetermined spray pattern of discrete streams aligned with the longer of said orifice axes, and at least one vertical, notched rib extending above said deflector surface; and a machined brass housing including a sleeve portion in which said insert is slidably and removably received, having generally cylindrical sidewalls extending above said orifice, a cut-away portion aligned with said deflector surface to permit the emission of said water spray pattern, an open bottom end through which said insert can be inserted, a threaded surface surrounding part of said sleeve portion adjacent said bottom end of said housing for holding said bottom end of said insert in communication with an irrigation water source, and a restraining member extending across the top end of said housing, said restraining member having an aperture therein that is off-center with respect to said sleeve, said rib projecting into said aperture and said notches engaging said restraining member, thereby preventing rotation of said insert relative to said housing;

said housing being susceptible of excessive wear by contact with irrigation water flow, and said insert being comparatively resistant to wear by contact with said flow.

* * * * *